US005529520A

United States Patent [19]

Iwashita et al.

[11] Patent Number: 5,529,520

[45] Date of Patent: Jun. 25, 1996

[54] PROPULSION SYSTEM FOR MARINE VESSEL

[75] Inventors: Takashi Iwashita; Yasushi Iriono; Yoshitugu Sumino; Hiroshi Harada, all of Hamamatsu, Japan

[73] Assignee: Sanshin Kogyo Kabushiki Kaisha, Hamamatsu, Japan

[21] Appl. No.: 318,056

[22] Filed: Oct. 4, 1994

[30] Foreign Application Priority Data

Oct. 4, 1993 [JP] Japan ..... 5-271255

[51] Int. Cl.[6] ..... B63H 5/10

[52] U.S. Cl. ..... 440/66; 440/80; 440/900

[58] Field of Search ..... 440/900, 88, 89, 440/79–81, 66; 416/909, 93 R, 93 A, 146 R, 146 B; 60/310

[56] References Cited

U.S. PATENT DOCUMENTS 3,434,447 3/1969 Christensen et al. ..... 440/89

4,871,334 10/1989 McCormick ..... 440/89

4,911,665 3/1990 Hetzel ..... 440/89

FOREIGN PATENT DOCUMENTS 0103792 5/1988 Japan ..... 440/80

*Primary Examiner*—Edwin L. Swinehart

*Attorney, Agent, or Firm*—Knobbe, Martens, Olson & Bear

[57] ABSTRACT

A propulsion unit for watercraft that employs a pair of counter-rotating propellers disposed one in front of the other in order to improve the performance upon acceleration, a cavitation effect is generated around at least one of the propellers at least during acceleration. Various ways in which this can be done employing the exhaust gases from the powering internal combustion engine for driving the propellers are illustrated.

26 Claims, 16 Drawing Sheets

PROPULSION SYSTEM FOR MARINE VESSEL

BACKGROUND OF THE INVENTION

This invention relates to a propulsion system for a marine vessel and more particularly to an improved counter-rotating propeller arrangement for such vessels.

It has been proposed to employ a propulsion system for watercraft that utilizes a pair of counter-rotating propellers that are disposed with a common rotational axis and one in front of the other. By using blades having a pitch of opposite hands, this dual propeller arrangement can provide significant improvements in propulsion efficiency. When the propulsion unit is provided with a forward neutral reverse transmission, the two propellers are both driven in opposite directions during a forward drive mode. Only one of the propellers is normally driven in reverse since the watercraft is normally not propelled at such large powers or at such high speeds in reverse.

Although this propulsion arrangement has a number of advantages, there are some areas where the performance can be improved. Although the dual propellers provides improved propulsion efficiency, when accelerating from a low speed to cruising or high speed conditions, the drag of the two propellers is significant enough to reduce the ability of the engine to accelerate as rapidly as desirable. As a result, these systems may at times provide less than maximum acceleration capabilities.

It is, therefore, a principal object of this invention to provide an improved dual propeller driving arrangement for a vessel.

It is a further object of this invention to provide an improved dual propeller assembly wherein the drag of at least one of the propellers is reduced at least on acceleration conditions so as to allow the engine and watercraft to accelerate more rapidly.

SUMMARY OF THE INVENTION

This invention is adapted to be embodied in a propulsion system for a watercraft having a pair of propellers of opposite hands, rotatable about a common axis and juxtaposed to each other with one propeller being disposed to the front of the other. Transmission means are incorporated for driving the propellers in opposite directions. Means are provided for delivering a gas in the vicinity of substantially only one of the propellers at least upon acceleration for producing a cavitation effect to allow the drive of said propellers to accelerate more rapidly.

DETAILED DESCRIPTION OF THE PREFERRED EMBODIMENTS OF THE INVENTION

Figure 1:
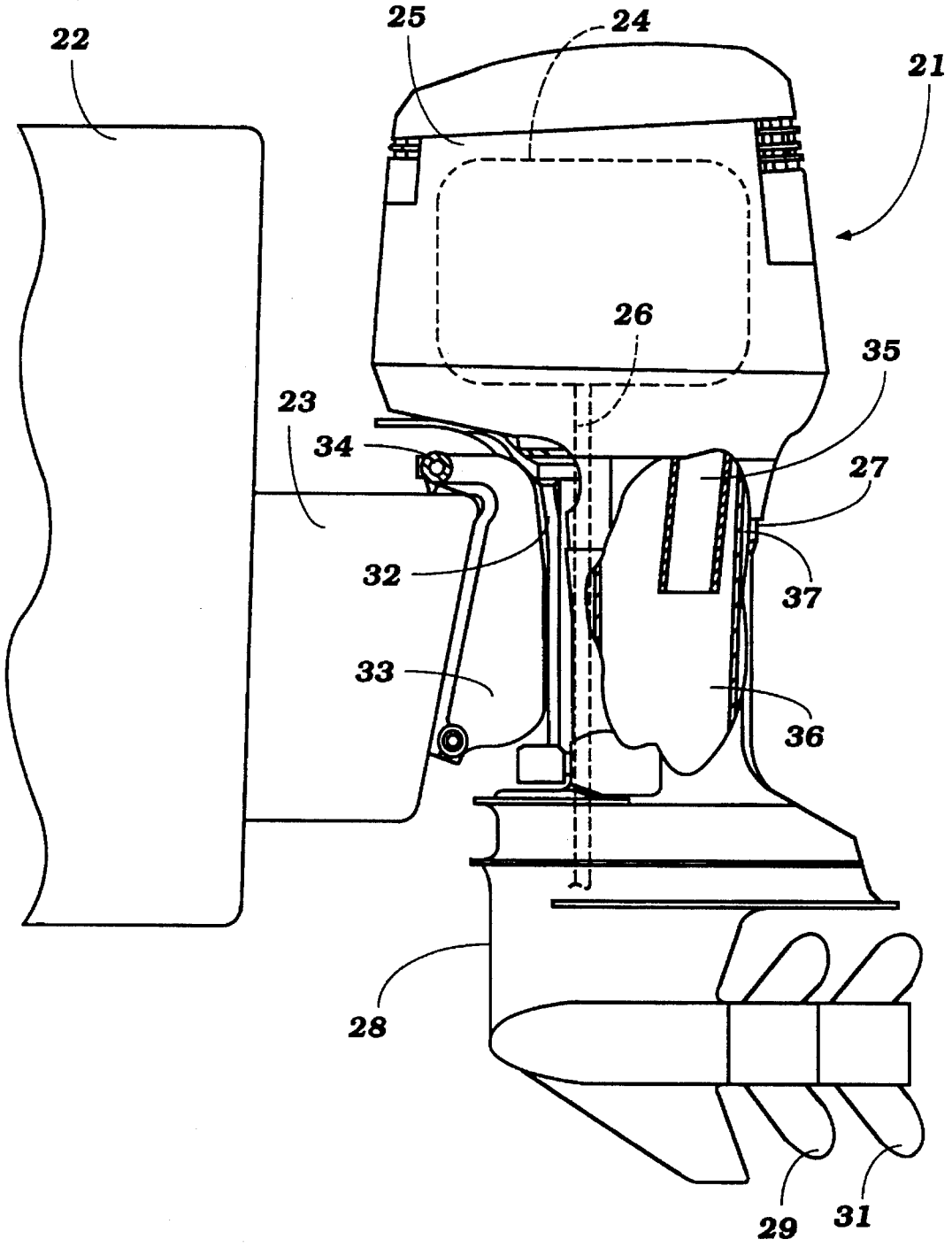
FIG. 1 is a side elevational view of a portion of a watercraft and attached outboard motor having a propulsion device constructed in accordance with a first embodiment of the invention, with a portion of the outboard motor broken away and shown in section.

Referring initially to FIG. 1, a side elevational view of an outboard motor, indicated generally by the reference numeral 21 as attached to the transom of a watercraft, shown partially and indicated by the reference numeral 22 by an outrigger bracket 23 is illustrated. The invention is described in conjunction with an outboard motor because the invention has particular utility with various types of marine or water vessel propulsion systems and particularly those employing counter-rotating propellers. Although the invention is described in conjunction with an outboard motor, it should be readily apparent to those skilled in the art how the invention can be employed with the outboard drive portions of an inboard/outboard drive or various other twin propeller propulsion systems.

The outboard motor 21 includes a power head that consists of an internal combustion engine 24 which may be of any known type and which is encircled by a protective cowling 25. Although the engine 24 may be of any type, as is typical with outboard motor practice the engine 24 is mounted in the power head so that its output shaft rotates about a vertically extending axis.

The output shaft of the engine 24 is drivingly coupled to a drive shaft 26 that is journaled for rotation within a drive shaft housing 27 that depends from the power head. This drive shaft 26 terminates in a lower unit 28 where it drives a pair of counter-rotating propellers 29 and 31 through a selectively operable forward neutral reverse transmission which will be described later by reference to FIG. 2.

It should be noted that the transmission for the propellers 29 and 31 is such that both propellers 29 and 31 will be driven in opposite directions under the forward drive mode. In reverse drive, on the other hand, only the rear propeller 31 is driven. In order to permit the counter-rotation to be effective, the propellers 29 and 31 are of opposite hand, as is well known in this art.

As is typical with outboard motor practice, a steering shaft 32 is affixed to the drive shaft housing 27 and is rotatably journaled in a swivel bracket, which is not shown in this figure. This pivotal movement permits steering of the outboard motor 21 about a generally vertically extending steering axis. The swivel bracket 32 is in turn connected to a clamping bracket 33 by means of a pivot pin 34 for tilt and trim movement of the outboard motor 21, as is also well known in this art.

The engine 24 is provided with an exhaust system that includes an exhaust manifold formed within the main casting of the engine 24 and which discharges through a downwardly facing discharge opening. An exhaust pipe 35 is affixed to a spacer plate upon which the engine 24 is supported and depends into an expansion chamber 36 formed in the drive shaft housing 27 by means including an inner casing 37. The exhaust system for the engine 24 is utilized as a source of pressurized gas for effecting cavitation around the front propeller 29 during acceleration conditions so as to improve acceleration performance, as will be described.

The transmission for driving the propellers 29 and 31 will now be described by particular reference to FIG. 2. It should be noted that the rear propeller 31 has a hub portion 38 that is connected by an elastic bushing 39 to an inner sleeve 41. The inner sleeve 41 has a splined connection to a main propeller shaft 43 and is held axially thereon by a threaded fastener 44 and washer 45 that engage an annular member 46 which is received within a hollow rear portion 47 of the hub 38.

The forward end of the sleeve 41 engages a thrust member 47 that engages a shoulder on the main propeller shaft 43 for transmitting forward drive forces through the propeller shaft 43 to the lower unit 28 in a manner which will be described.

The forward propeller 29 has a hub portion 49 that is bonded to an elastomeric sleeve 51 which is, in turn, bonded to an inner sleeve 52. The inner sleeve 52 has a splined connection to a quill shaft 53. The quill shaft 53 is journaled on the main propeller shaft 43 at its rear end by means of a needle bearing assembly 54.

The front propeller 29 is axially affixed to the quill shaft 53 by means of a snap or retainer ring 55 that is juxtaposed to a forward end 56 of the rear propeller hub 38 and a washer or ring 57 that is received within the rear portion 58 of the hub 49 of the front propeller 29. A thrust bearing 59 is interposed between the thrust ring 48 of the rear propeller 31 and the rear end of the quill shaft 53.

The front propeller 29 transmits its driving thrust in the forward direction to the quill shaft 53 via a thrust ring 61 that is loaded between a shoulder on the quill shaft 53 and the forward portion of the inner sleeve 52.

A bearing carrier, indicated generally by the reference numeral 62 is inserted into a cavity of the lower unit 28 through an annular opening 63 formed at the rear end thereof. This bearing carrier 62 has a rear portion 64 that is held within the opening 63 by a retainer ring 65. This rear portion 64 also carries a set of needle bearings 66 which journal the intermediate portion of the quill shaft 53. The forward end of the quill shaft 53 is journaled by a third row of needle bearings 67 which are positioned at a front portion of the bearing carrier 62. The bearing carrier 62 has a ring-like outer portion 68 which the retainer ring 65 engages and which is spaced from the portion 64 to define an annular gap 69 therearound for a purpose which will be described. A rear portion 71 of the bearing carrier 62 extends in close proximity to a front portion 72 of the hub 49 of the front propeller 29.

As has been noted, the propellers 29 and 31 are driven by the drive shaft 26 by a transmission, indicated generally by the reference numeral 73. The transmission 73 is of the counter-rotating bevel gear type normally employed in marine propulsion units. This bevel gear transmission comprises a driving bevel gear 74 that is affixed to the lower end of the drive shaft 26 and is enmeshed with a pair of counter-rotating bevel gears comprised of a front bevel gear 75 and a rear bevel gear 76 which are engaged with diametrically opposed sides of the driving bevel gear 74. Thus the bevel gears 75 and 76 will rotate in opposite directions.

The front bevel gear 75 has a hub portion that is journaled in the lower unit 28 on a thrust bearing 80. This bevel gear 75 is also engaged by a shoulder on a forward portion 77 of the main propeller shaft 43 so as to transmit forward driving thrust from the rear propeller 31 to the lower unit through the thrust bearing 80. A row of needle bearings 78 is interposed between the bevel gear 75 and the front portion 77 of the main propeller shaft 43 for rotatably journaling the bevel gear 75 for rotation relative to the propeller shaft 43.

The rear bevel gear 76 has a sleeve portion that is received within a needle bearing assembly 79 having an outer cage 81 that is received and retained within an enlarged forward portion of the bearing carrier 62 by means of a retainer ring 82. The forward end of the quill shaft 53 is slidably received and journaled within the hub of the rear bevel gear 76 by this needle bearing assembly 79, 81.

The transmission assembly 73 further includes a dog clutching sleeve 83 that has a splined connection on the outer end of a forward portion of the main propeller shaft 43. The dog clutching sleeve 83 has forwardly facing dog clutching teeth 84 that are adapted to be brought into engagement with corresponding dog clutching teeth 85 of the forward bevel gear 75 for driving the propeller shaft 43 in a forward drive position. FIG. 2 shows the dog clutching sleeve 83 in a neutral position wherein the dog clutching teeth 84 and 85 are not engaged.

In addition, the dog clutching sleeve 83 has rearwardly facing dog clutching teeth 86 that are adapted to engage corresponding dog clutching teeth 87 formed on the forward face of the rear bevel gear 76. When the dog clutching teeth 86 and 87 are engaged, the propeller shaft 43 and rear propeller 31 will be driven in a reverse direction for achieving reverse driving thrust.

An actuating mechanism is provided for movement in the dog clutching sleeve 83 between its neutral, forward drive and reverse drive positions. This mechanism includes a pin 88 that extends transversely through the dog clutching sleeve 83, an elongated slot 89 formed in the forward main propeller shaft portion 77 and a corresponding opening in an actuating plunger 91. The pin 88 is retained in position within the dog clutching sleeve 83 in a known manner, by means of a circular spring or clip (not shown).

The actuating plunger 91 is received within a bore 92 at the forward portion 77 of the main propeller shaft 43. Because of the relationship of the pin 88 with the slot 89 and the slot in the actuating plunger 91, these components will rotate together but the actual driving force between the bevel gears 75 and 76 and the propeller shaft 43 will be transmitted through the spline connection between the dog clutching sleeve 83 and the main propeller shaft 43.

The forward end of the plunger 91 is captured in a slot formed in an actuating cam 93 which is slidably supported in a known manner in the front of the lower unit 28. This actuating cam 93 receives a crank portion 94 of an actuating rod 95 which is journaled for rotation in the lower unit 28 and extends upwardly to a transmission actuator mechanism (not shown) for reciprocating the cam 93 and the plunger 91 so as to shift the dog clutching element 86 between the neutral position as shown in FIG. 2, a forward drive position wherein the dog clutching teeth 84 and 85 are engaged and a reverse drive position wherein the dog clutching teeth 86 and 87 are engaged.

A detent mechanism is provided that cooperates between the plunger rod 91 and the propeller shaft 43 for retaining the dog clutching element 83 in its neutral position, for providing a predetermined force to resist shifting for torsionally loading the shift rod 85 and then release and snap engagement in the forward and reverse drive positions. This mechanism is of the type described in U.S. Pat. No. 4,570,776, issued Feb. 18, 1986 and entitled "Detent Mechanism for Clutches", which patent is assigned to the Assignee hereof. This patent shows full details of the detent mechanism and also the clutching actuating mechanism as thus far described and is incorporated herein by reference.

This detent mechanism includes a plurality of detent balls 96 that are held in place between the propeller shaft forward portion 77 and which are engaged by a ball 97 which is, in turn, engaged by one end of a coil compression spring 98. The opposite end of the spring 98 engages a further ball 101 which operates with detent balls 102 to urge them into engagement with a cam groove 103 formed in the propeller shaft forward portion 77 and a further neutral locking groove 103 as described in that patent for achieving the aforedescribed operation. Since this mechanism forms no significant part of the invention, a further description of it is believed to be unnecessary.

The aforedescribed transmission 73 and dog clutching element 83, as described, are effective to operate the rear propeller 31 in forward or reverse drive position. In addition, a further clutch mechanism is provided that is driven by a portion of the transmission 73 for driving the propeller 29 and quill shaft 53 in only its forward drive position. As has already been noted, this forward drive rotation is counter to the forward drive rotation of the rear propeller 31. Hence, to achieve forward drive of the front propeller 29 it is shifted into rotating interaction with the rear bevel gear 76 while the rear propeller 31 is engaged with the front bevel gear 75 for its forward drive.

This clutching mechanism is comprised of a further dog clutching sleeve 105 which has an externally splined surface that forms a splined connection with the tubular forward extension of the quill shaft 53 so as to establish a driving relationship with it. The dog clutching sleeve 105 has a forwardly facing set of dog clutching teeth 106 that are adapted to be brought into meshing relationship with rearwardly facing dog clutching teeth 107 on the rear of the rear bevel gear 76 and which face in the opposite direction of their teeth 87. A pin 108 extends transversely through a slot 109 formed in the propeller shaft 43 and has a connection to the actuating plunger 91 formed by a transversely extending bore in it.

FIG. 2, again, shows the neutral position of the rear dog clutching sleeve 105 and it will be seen that this dog clutching sleeve is in neutral when the forward dog clutching sleeve 83 is in neutral. Upon shifting in a forward direction by moving the plunger 91 forwardly, the dog clutching teeth 106 and 107 move into engagement and establish a driving relationship between the rear bevel gear 76, the dog clutching sleeve 105 and the quill shaft 53 for rotating the propeller 29 in its forward drive direction.

When the transmission 73 for driving primarily the rear or main propeller 31 is shifted into reverse, the dog clutching teeth 106 and 107 will be maintained out of engagement and the rear propeller 29 and quill shaft 53 will merely idle.

The dual propeller drive for driving the watercraft 22 in its forward drive mode provides very good propulsion efficiency and minimizes drag under normal running. As has been noted, however, upon acceleration from idle to cruise or high speed conditions, the additional drive of the propeller 29 will provide some drag and extra load on the engine 24 so as to inhibit its acceleration. In accordance with the invention, an arrangement is provided for inducing cavitation around the propeller 29 under this condition which will permit more rapid acceleration. This cavitation is accomplished by delivering a gas in proximity to the forward hub portion 72 so that it will move around the blades of the propeller 29 and reduce their drag. In accordance with all of the illustrated embodiments of the invention, the gas utilized for this purpose is the exhaust gas from the engine 24.

It has been noted that exhaust gases from the engine 24 enter the expansion chamber 36 of the drive shaft housing 27. These exhaust gases then flow downwardly through an exhaust gas passage 110 that is formed in the lower unit 28 and which terminates adjacent the bearing carrier 62. As has been previously noted, the bearing carrier 62 provides an annular gap 69 around its outer periphery and this annular gap is disposed substantially in alignment with the forward portion 72 of the hub of a front propeller 29. The exhaust gases are discharged through this gap as shown by the arrows 111 in FIGS. 2 and 3 and thus will flow outwardly, particularly under lower speed conditions, and impinge on the blades of the propeller 29. This impingement will cause some cavitation effect around the propeller 29 which reduces its drag and permits the propeller 31 to be accelerated more rapidly along with the propeller 29. However, the action of the blades of the propeller 29 will drive the exhaust gases outwardly away from the rear propeller 31 so that there will be substantially no cavitation effect occurring there.

Also, since the hubs 49 and 38 of the front and rear propellers 29, 31 are substantially the same diameter, the exhaust gases can flow rearwardly without inducing any significant cavitation around the rear propeller 31.

As the engine reaches its full speed, the exhaust gas flow will tend to have less effect on cavitation and the water flow across the propellers 29 and 31 will increase so that there will be no significant loss of propulsion efficiency when traveling at high speeds. That is, the exhaust gases generally create a cavitation effect primarily only during acceleration.

The remaining embodiments of the invention all illustrate various other ways in which exhaust gases may be discharged and some cavitation effect generated around the blades of the front propeller 29 during forward acceleration. Because this is the only difference from the previously described embodiments, those components of the following described embodiments which are the same as those previously described have been indicated by the same reference numerals and will be described again only insofar as is necessary to understand the construction and operation of these embodiments.

Figure 2:
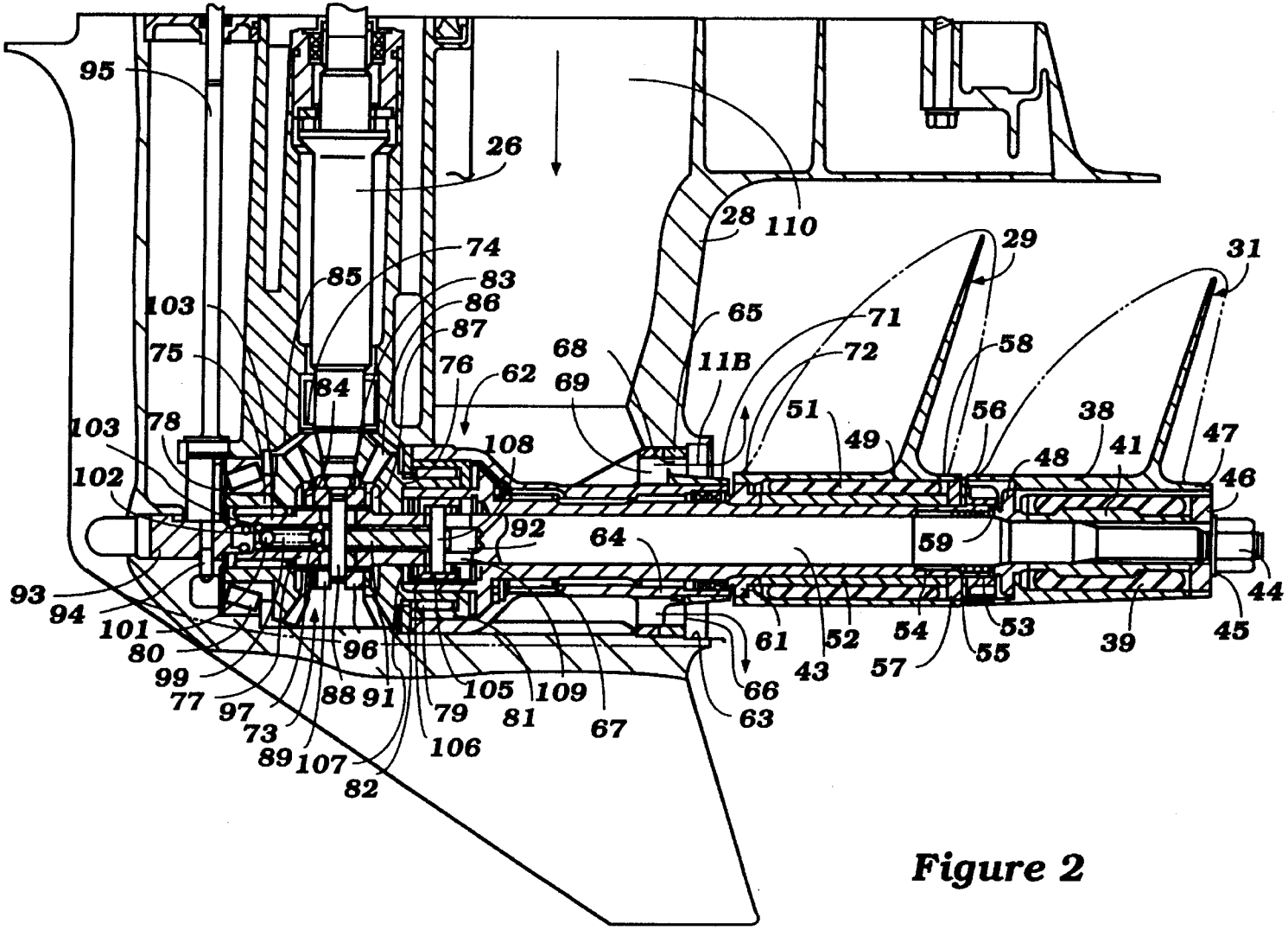
FIG. 2 is an enlarged longitudinal cross-sectional view taken along the rotational axes of the propellers of the lower unit of this embodiment.
Figure 3:
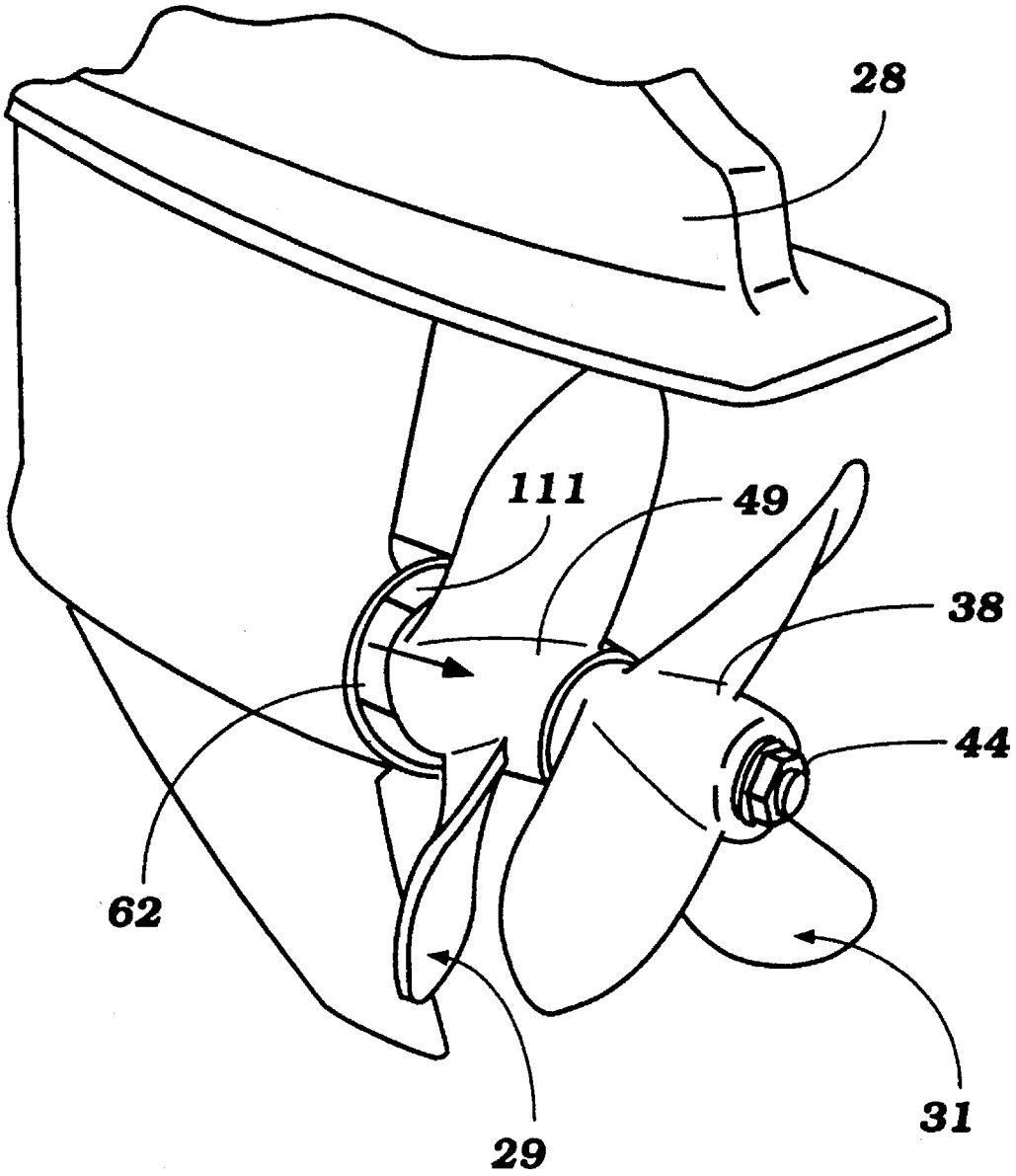
FIG. 3 is a perspective view taken from the rear and one side showing the exhaust arrangement of this embodiment.

In the embodiment of FIGS. 1–3, all of the exhaust gases from the engine were discharged forwardly of the forwardmost propeller 29. This will provide the most cavitation effect on acceleration but also can possibly result in some loss of propulsion efficiency under steady state high speed running conditions. Therefore, each of the following embodiments incorporate an arrangement wherein only a portion of the exhaust gases are utilized for cavitation and the rest or a bulk of the exhaust gases are discharged through a through the hub propeller-type exhaust. This exhaust includes an arrangement wherein the outer hub 49 of the front propeller is provided with an outer portion 201 and an inner portion 202 that are spaced from each other but which are interconnected by a plurality of circumferentially spaced ribs, as is well known in this art. This defines axially extending through the hub exhaust gas discharge passages 203. The inner portion 202 of the hub 249 is connected to the quill shaft 53 by a construction the same as that of FIG. 2 and this construction will not be describes but the components thereof have been identified by the same reference numerals as that previously applied. In this construction, the passage 203 communicates directly with the passageway 69 formed in the bearing carrier 62 so that the bulk of the exhaust gases will enter this passageway 203.

In a like manner, the hub 38 of the rear propeller 31 is comprised of an outer cylindrical section 204 and an inner cylindrical section 205 that are connected to each other by a plurality of ribs and which define a further through the hub exhaust gas passage 206 that is concentric with and complementary through the hub exhaust discharge path 203 of the front propeller 29. Like the front propeller 29, the rear propeller 31 is connected to the main propeller shaft 43 by a construction which is the same and thus has the same numbers as the previously described embodiment.

It should be noted that in this embodiment, the rearward portion of the outer hub part 201 of the front propeller 209 and the forward portion of the outer part 204 of the hub 38 of the rear propeller 31 have telescopically received portions 207 and 208, respectively, so as to provide a relatively tight exhaust gas passage so as to preclude any exhaust gases from leaking around the area in front of the rear propeller 31 so that no cavitation effect can occur around this propeller.

In order to provide a cavitation effect, there is provided a generally arcuate exhaust gas cavitation path 209 in the lower unit 28 around the opening 63. This opening 209 communicates with the exhaust passage 109 in the lower unit 28 so as to discharge some of the exhaust gases in proximity to the upper portion of the front propeller 29 outwardly of its hub 49. Hence, the cavitation effects to improve acceleration as aforedescribed can be obtained and, at the same time, it will be ensured that there will be little or no cavitation effect around the rear propeller 31.

Figure 4:
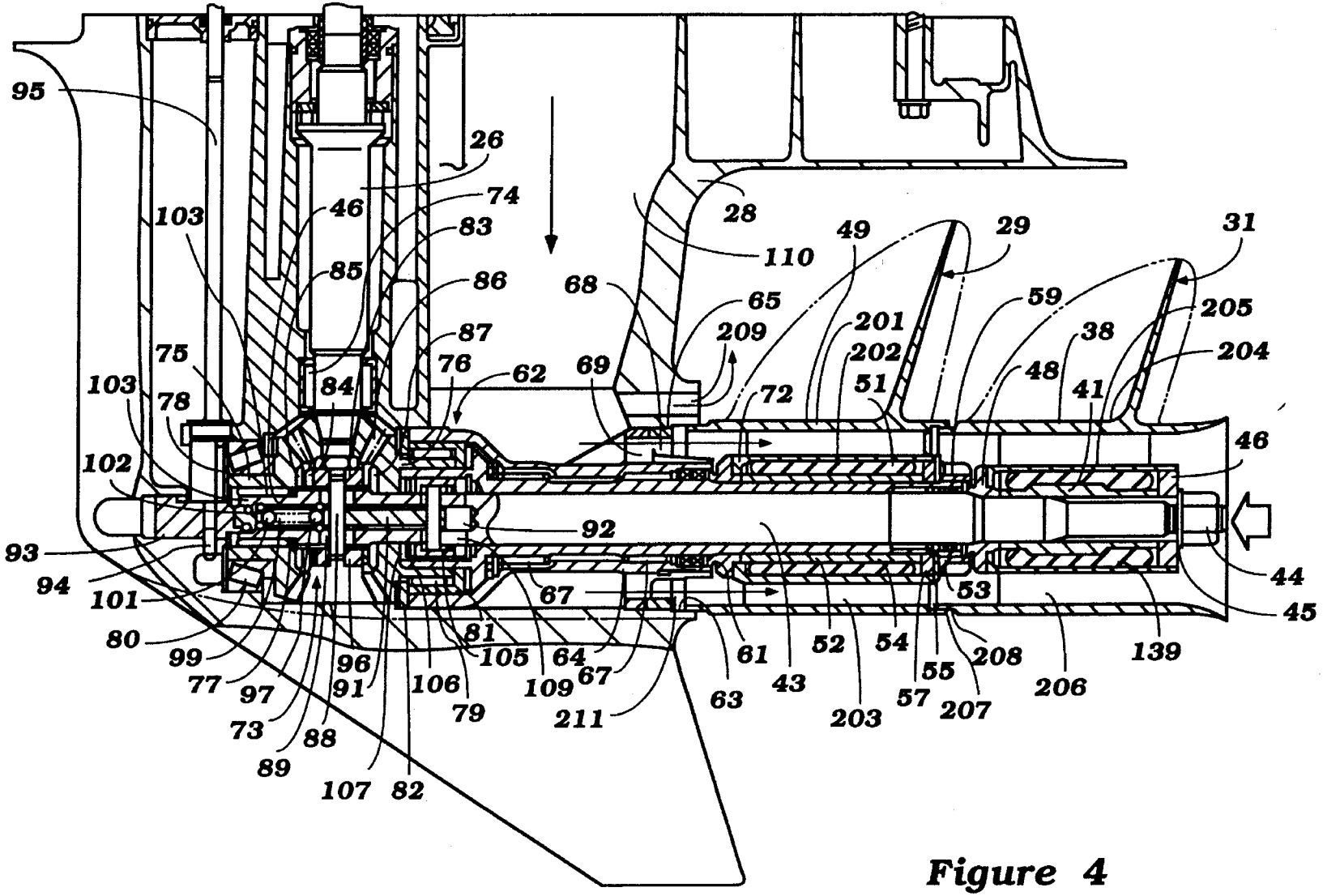
FIG. 4 is a cross-sectional view, in part similar to FIG. 2 and shows another embodiment of the invention.
Figure 5:
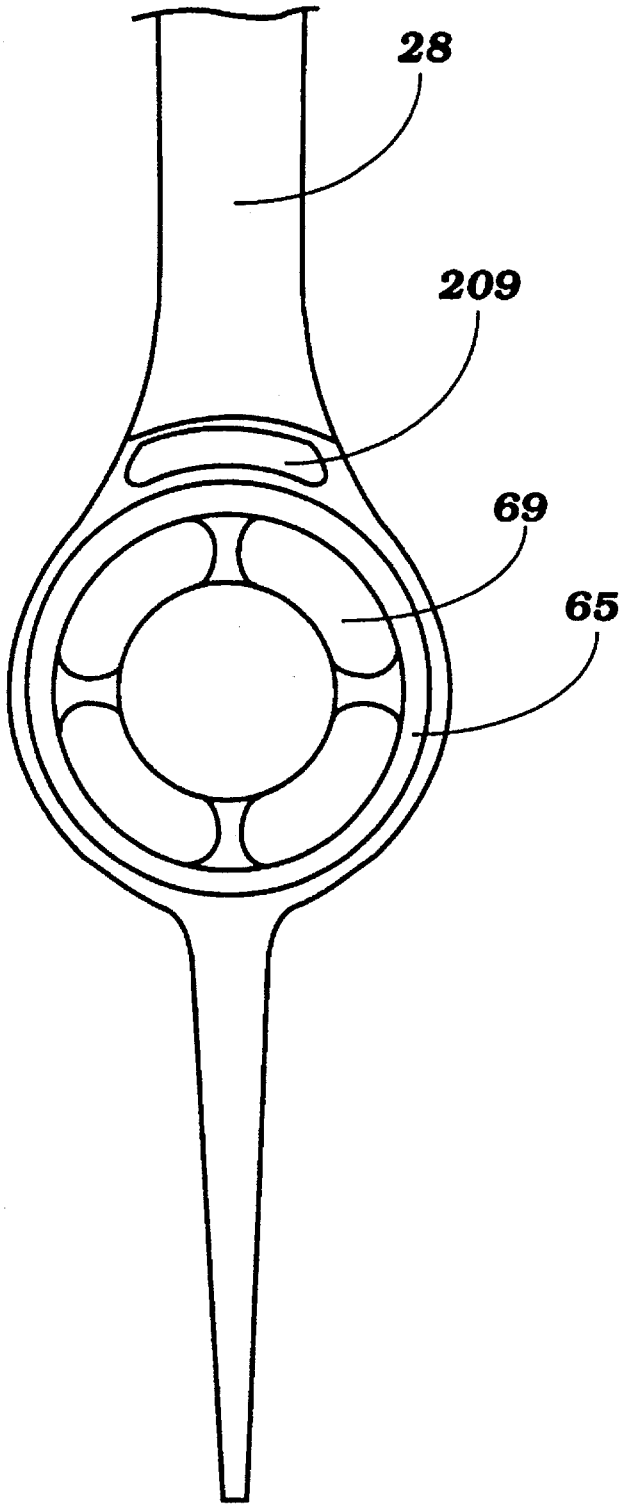
FIG. 5 is a rear elevational view of the lower unit of the embodiment of FIG. 4.
Figure 6:
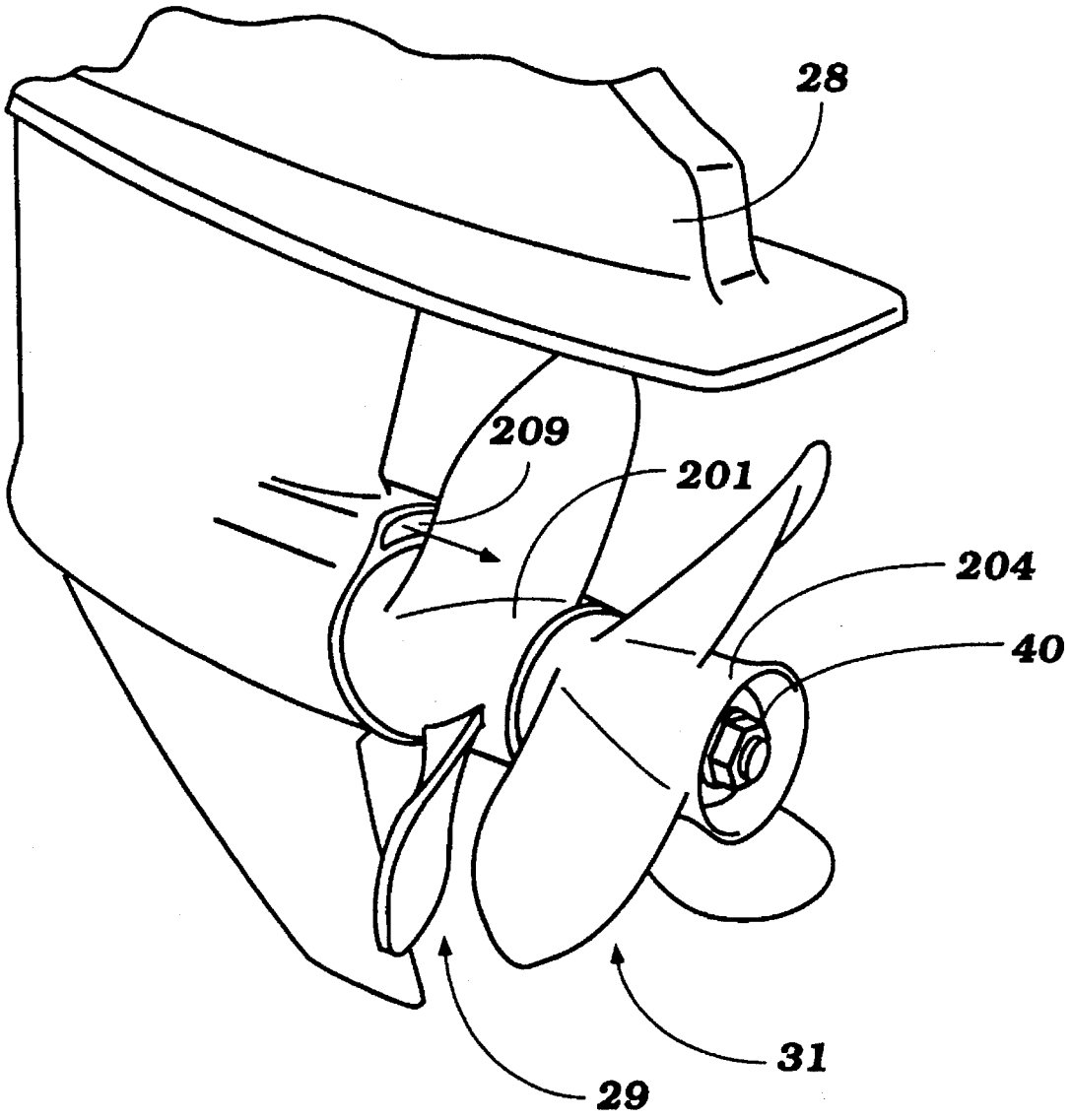
FIG. 6 is a perspective view taken from the rear and one side of this embodiment.
Figure 7:
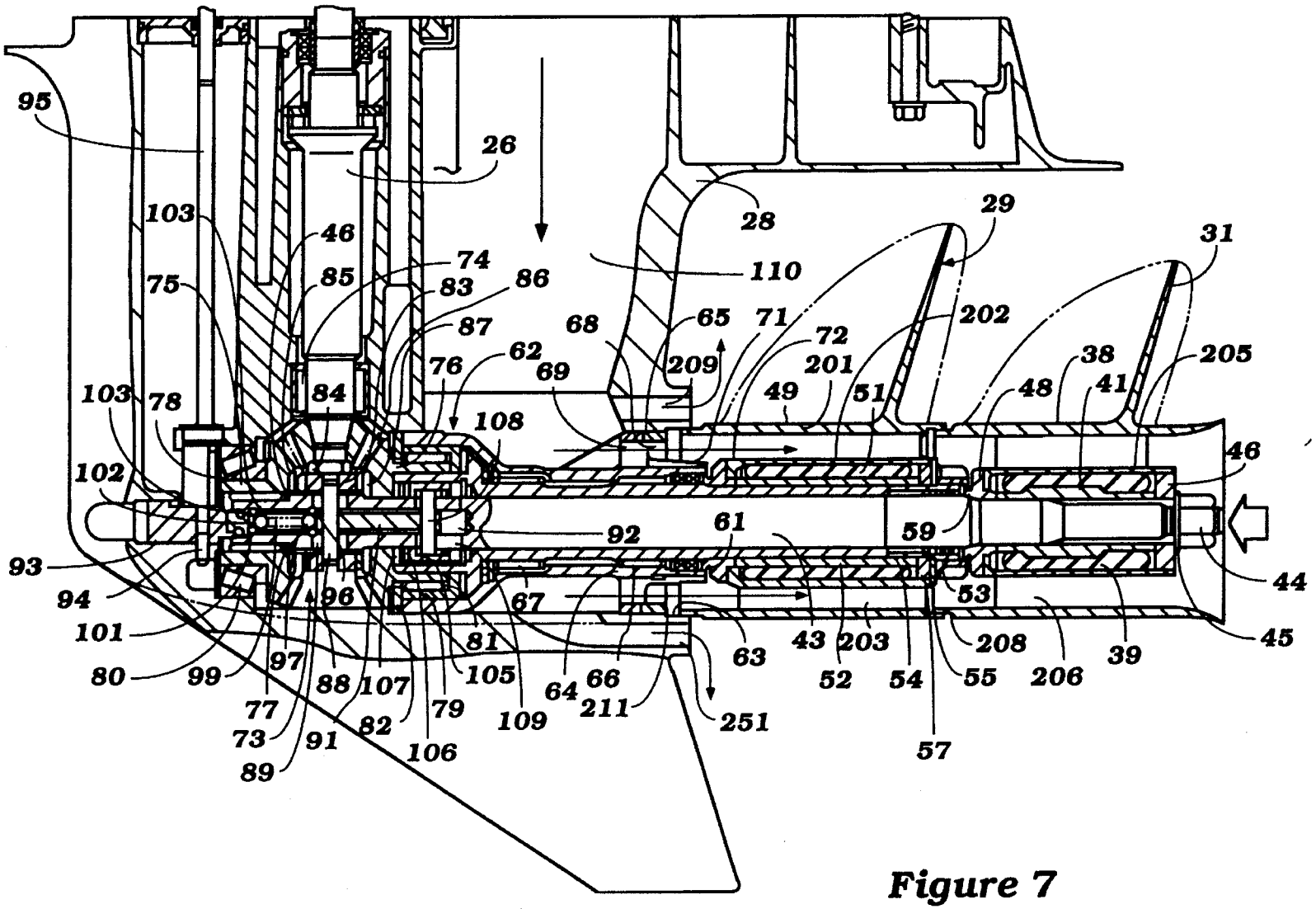
FIG. 7 is a cross-sectional view, in part similar to FIGS. 2 and 4 and shows a third embodiment of the invention.
Figure 8:
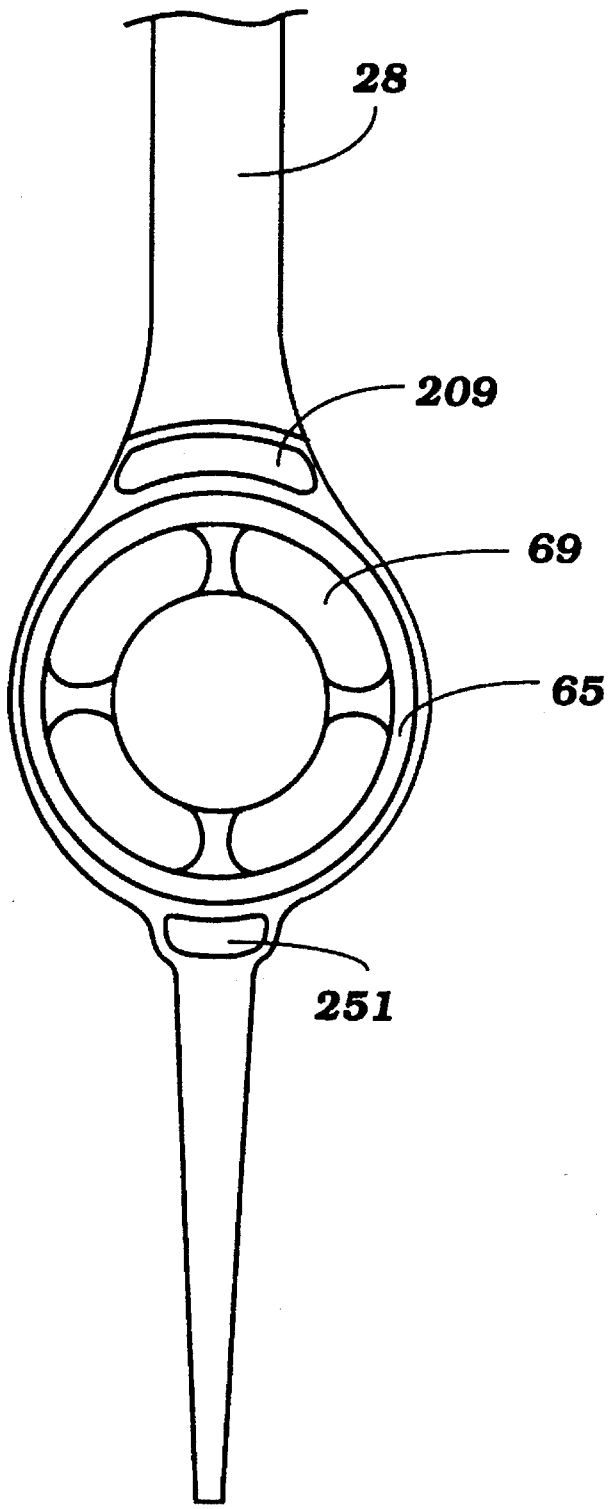
FIG. 8 is a rear elevational view of the lower unit of this embodiment.
Figure 9:
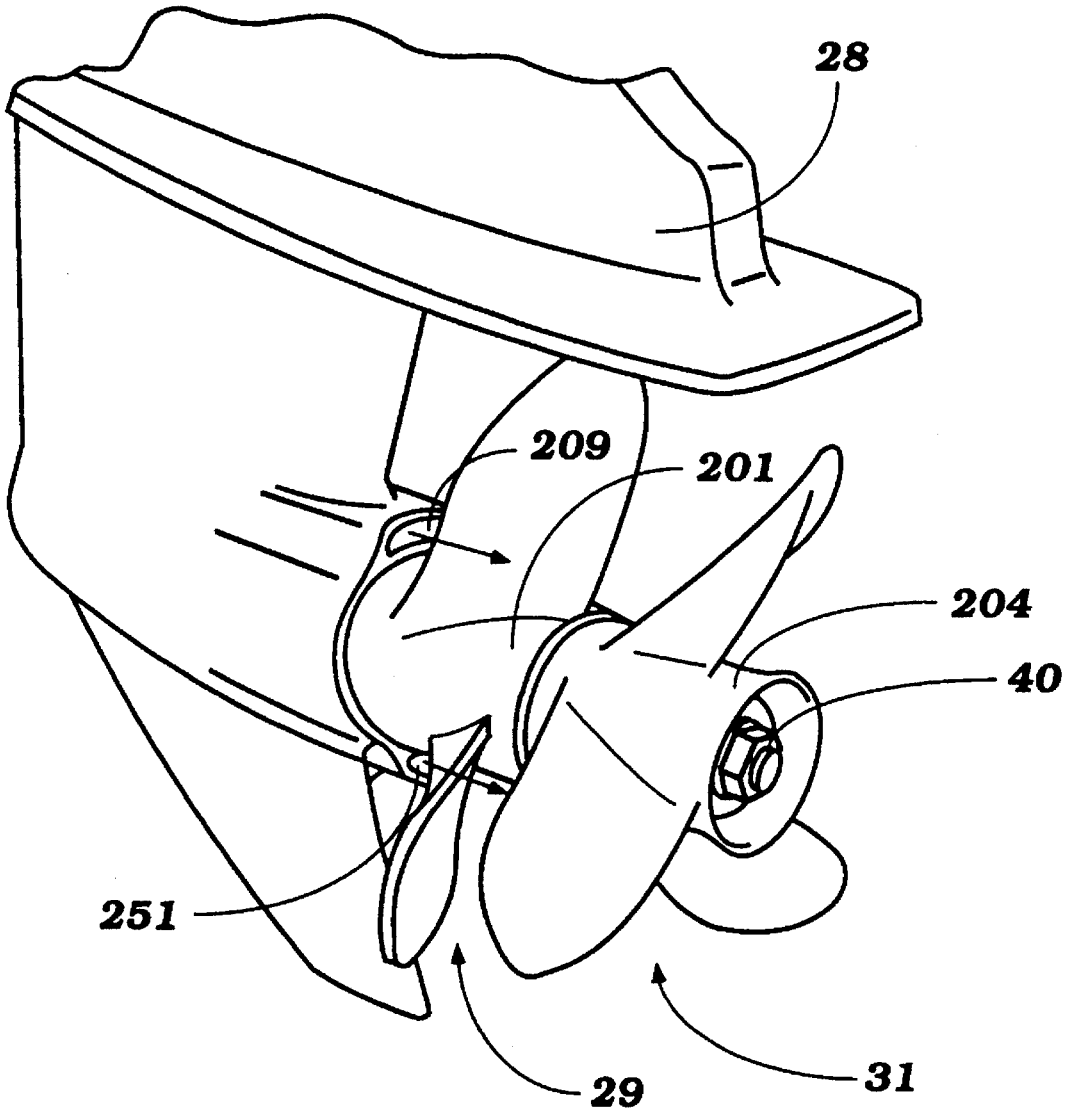
FIG. 9 is a perspective view, taken from the rear and one side, of this embodiment.
Figure 10:
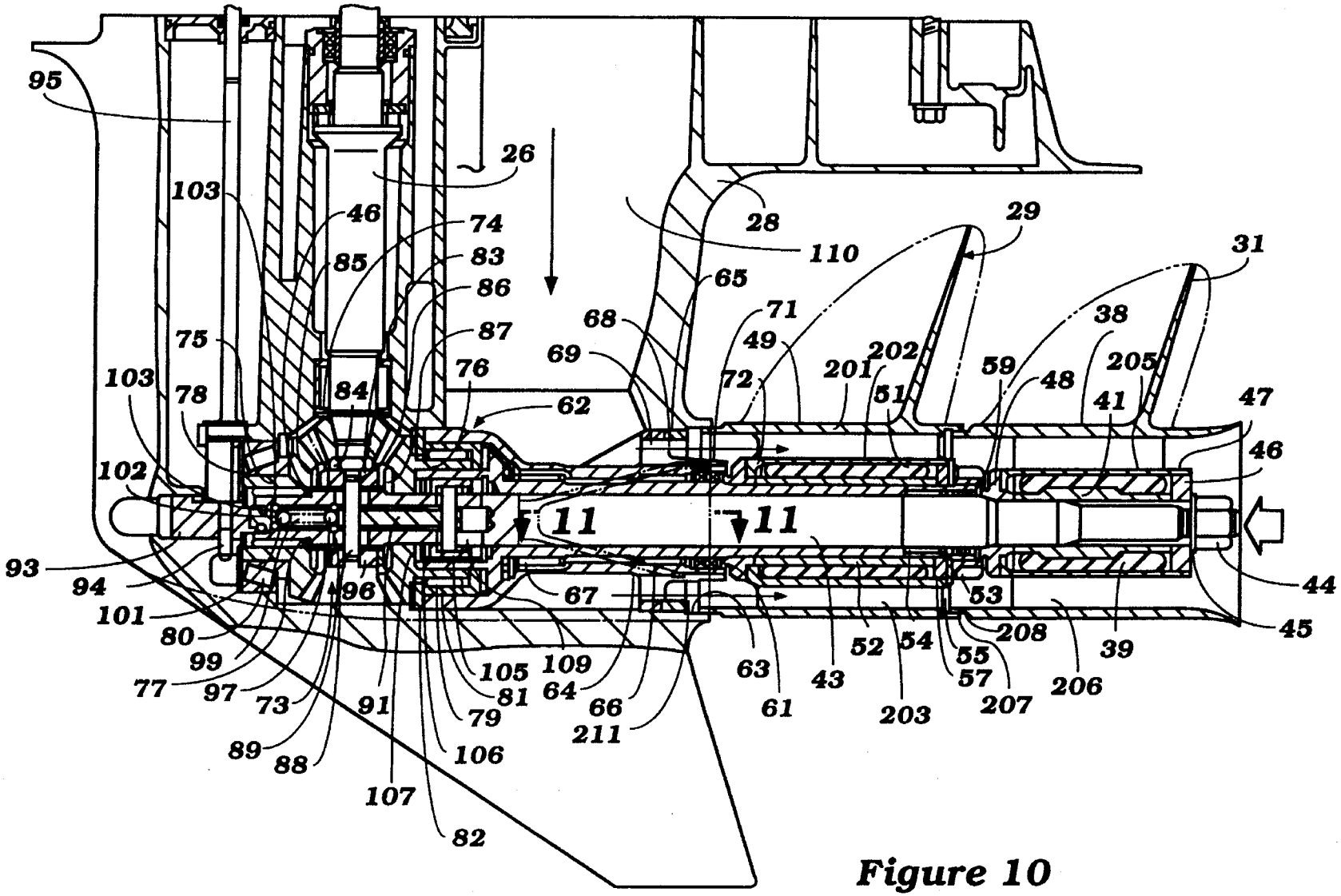
FIG. 10 is a cross-sectional view, in part similar to FIGS. 2, 4, and 7, and shows a fourth embodiment of the invention.
Figure 11:
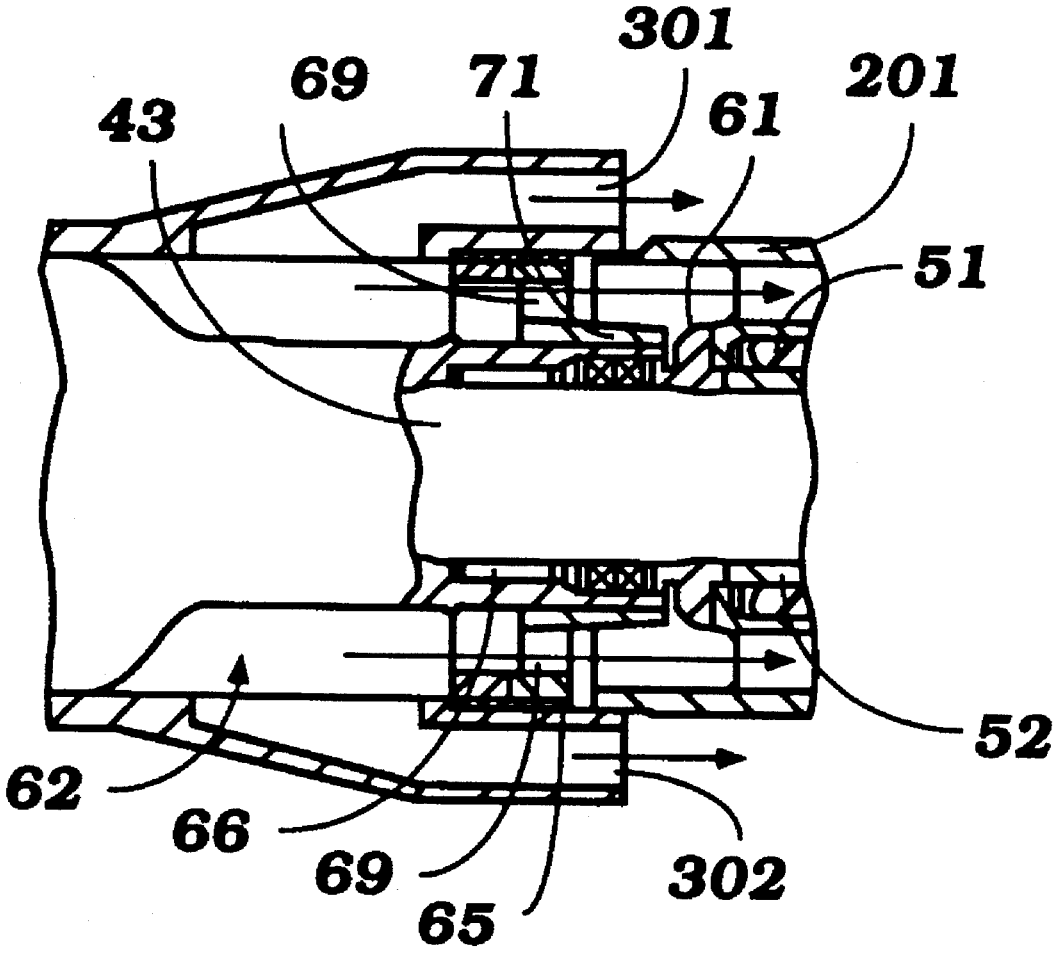
FIG. 11 is a cross-sectional view taken along the line 11—11 of FIG. 10.
Figure 12:
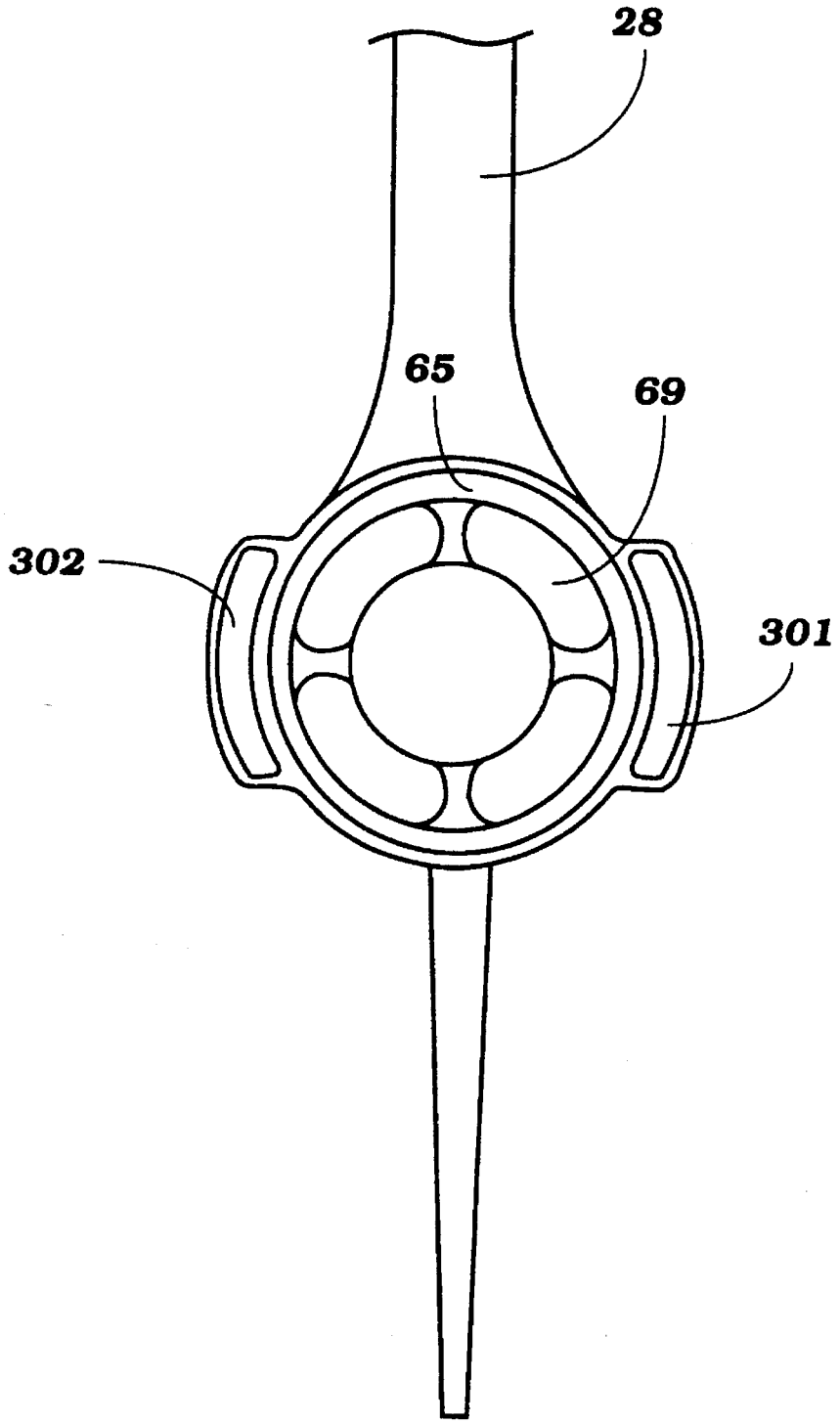
FIG. 12 is a rear elevational view of the lower unit of the fourth embodiment.
Figure 13:
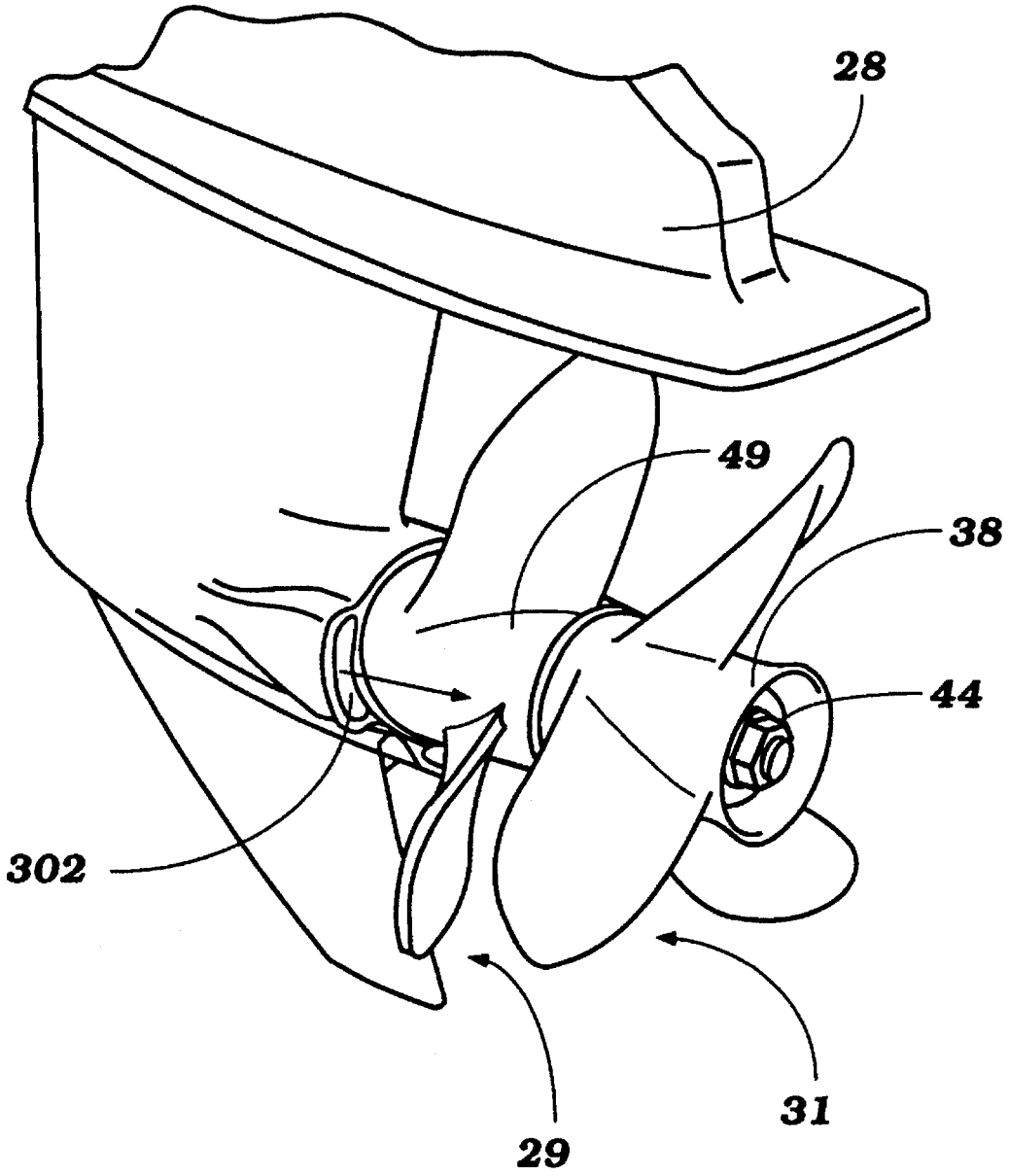
FIG. 13 is a perspective view, taken from the rear and one side of this fourth embodiment.

FIGS. 7–9 show another embodiment of the invention which is basically the same as the embodiment of FIGS. 4–6 and, for that reason, components of this embodiment which are the same have been identified by the same reference numerals and will not be described again except by reference to the specific features of this embodiment. In this embodiment, the lower unit housing 28 is provided with a further cavitation passageway 251 which may have less circumferential extent but which is positioned below the upper cavitation passageway 209. Like the passageway 209, the passageway 251 is disposed radially outwardly beyond the outer portion 201 of the front propeller hub 49 and from the foregoing description the operation of this embodiment should be readily apparent.

FIGS. 10–13 show a still further embodiment of the invention which follows a principal similar to the embodiments of FIGS. 4–6 and 7–9. In these embodiments, however, the lower unit housing 28 is provided with a pair of side cavitation slots 301 and 302 which are disposed radially outwardly of the outer portion 201 of the front propeller hub 49 and which communicates with the exhaust passage 110 in the lower unit 28. These cavitation passages 301 and 302 are disposed radially outwardly of the hub passages 203 of the front propeller 29 and 206 of the rear propeller 31.

In the embodiments other than that of FIGS. 1–3 that have been thus far described, it should be noted that the water pressure at the cavitation passages 209, 251, 301, and 302 will be relatively low when traveling at low speeds and hence the anti-cavitation effect can be achieved. However, as the speed of the watercraft increases, the hub 49 of the front propeller 29 will tend to obscure some of the flow and the water pressure in this area will be higher and hence the percentage of the exhaust gases flowing through these cavitation producing exhaust passages will be less than that flowing through the hub exhaust gas passages so as to avoid any deleterious effect on high speed performance.

Figure 14:
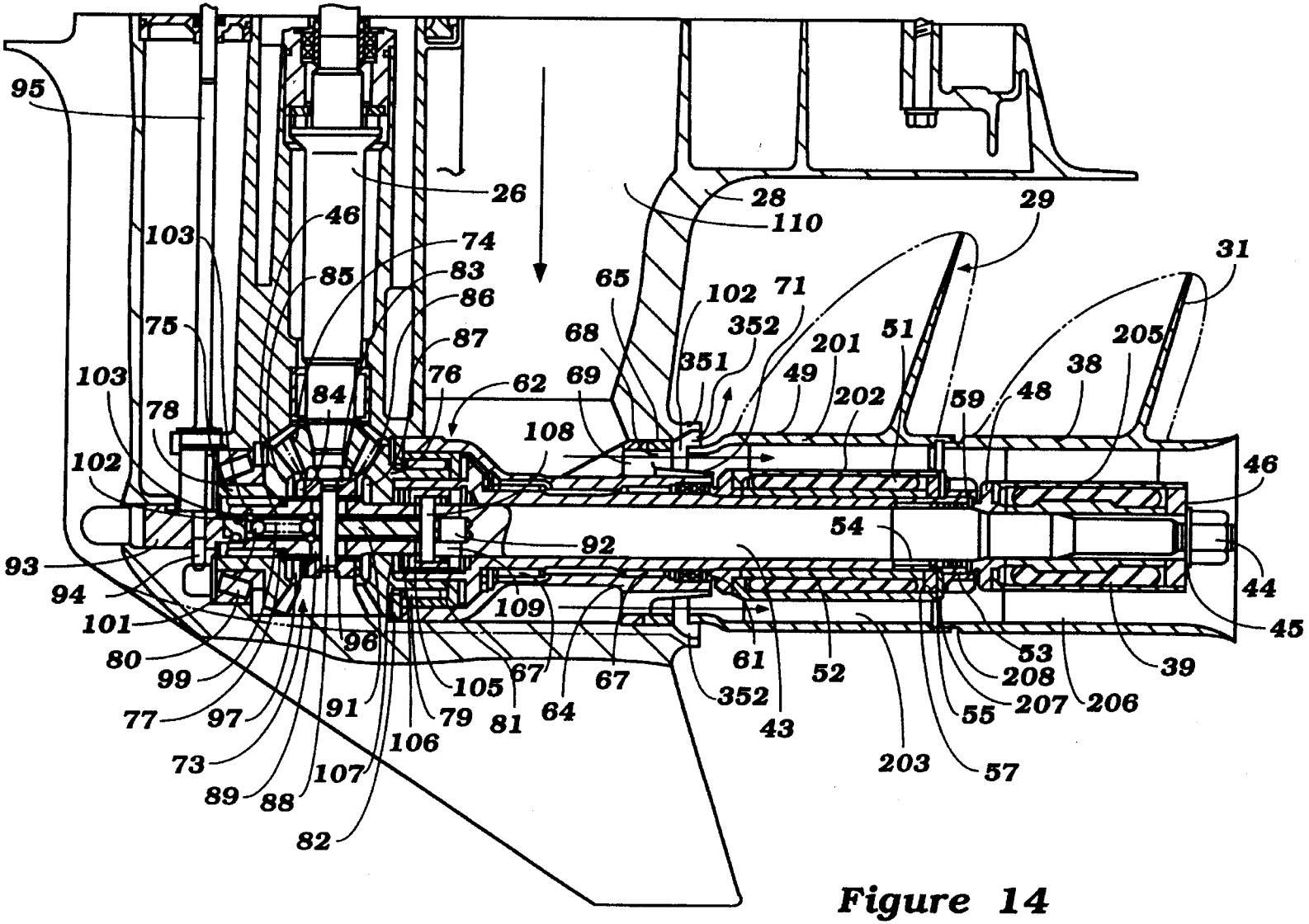
FIG. 14 is a cross-sectional view, in part similar to FIGS. 2, 4, 7, and 10 and shows a fifth embodiment of the invention.
Figure 15:
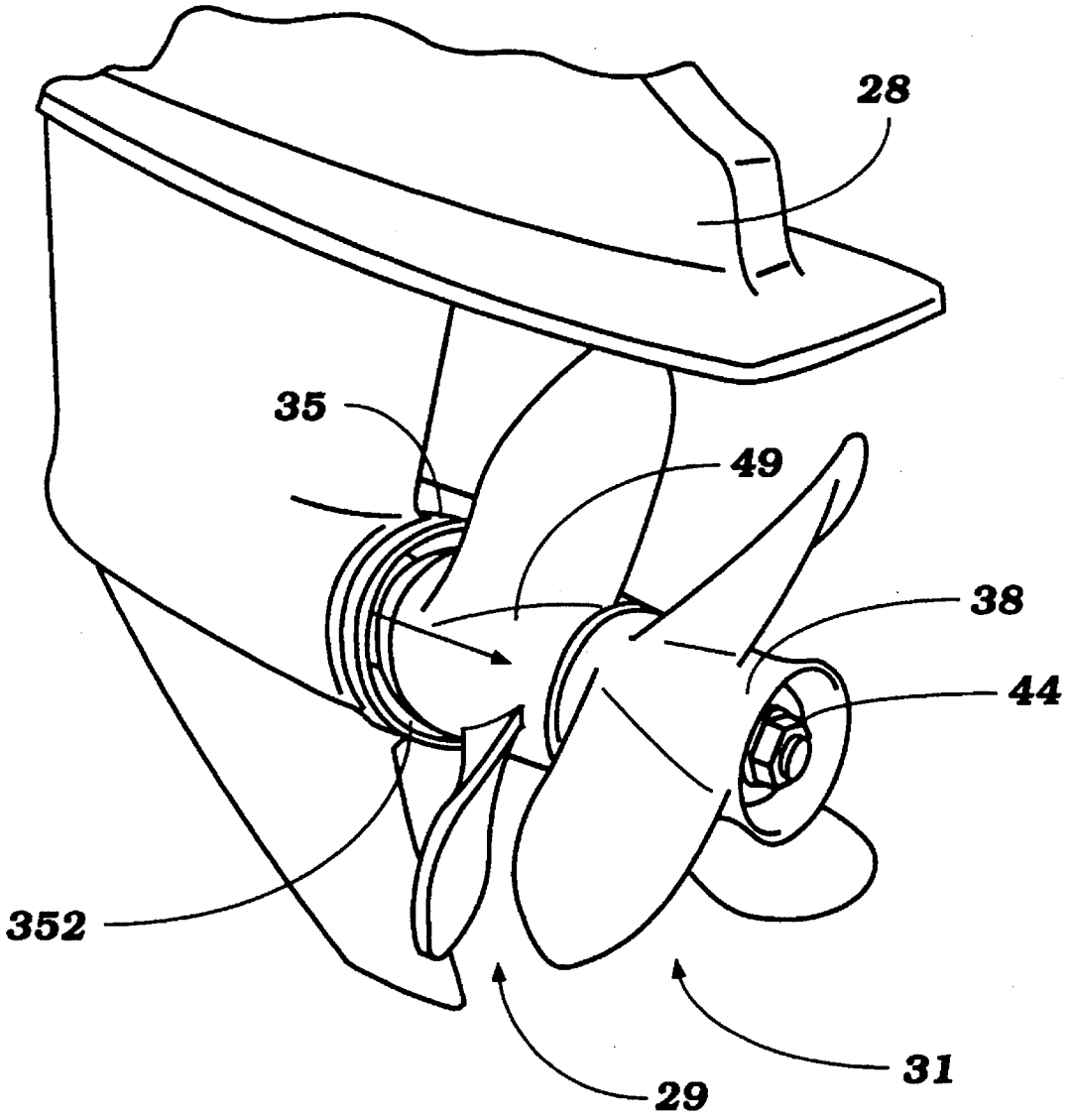
FIG. 15 is a perspective view, taken from the rear and one side, of this fifth embodiment.

FIGS. 14 and 15 show another way in which this same effect can be generated. In these embodiments, the lower unit 28 and specifically its outer housing is provided with a flared portion 351 that defines an annular cavitation passageway 352 which communicates with the main exhaust gas discharge passageway 69. In a similar manner, the outer portion 201 of the hub 49 of the front propeller 29 is formed with a reduced diameter portion 353 that extends in part into this opening so as to deflect a portion of the exhaust gases flowing outwardly as seen in FIGS. 14 and 15 so as to generate the cavitation effect. However, as the speed of the watercraft increases, a portion of the exhaust gases flowing in this area will be reduced. The proportion of flow can be controlled by controlling the gap formed between the hub portion 352 and the lower unit portion 351.

Figure 16:
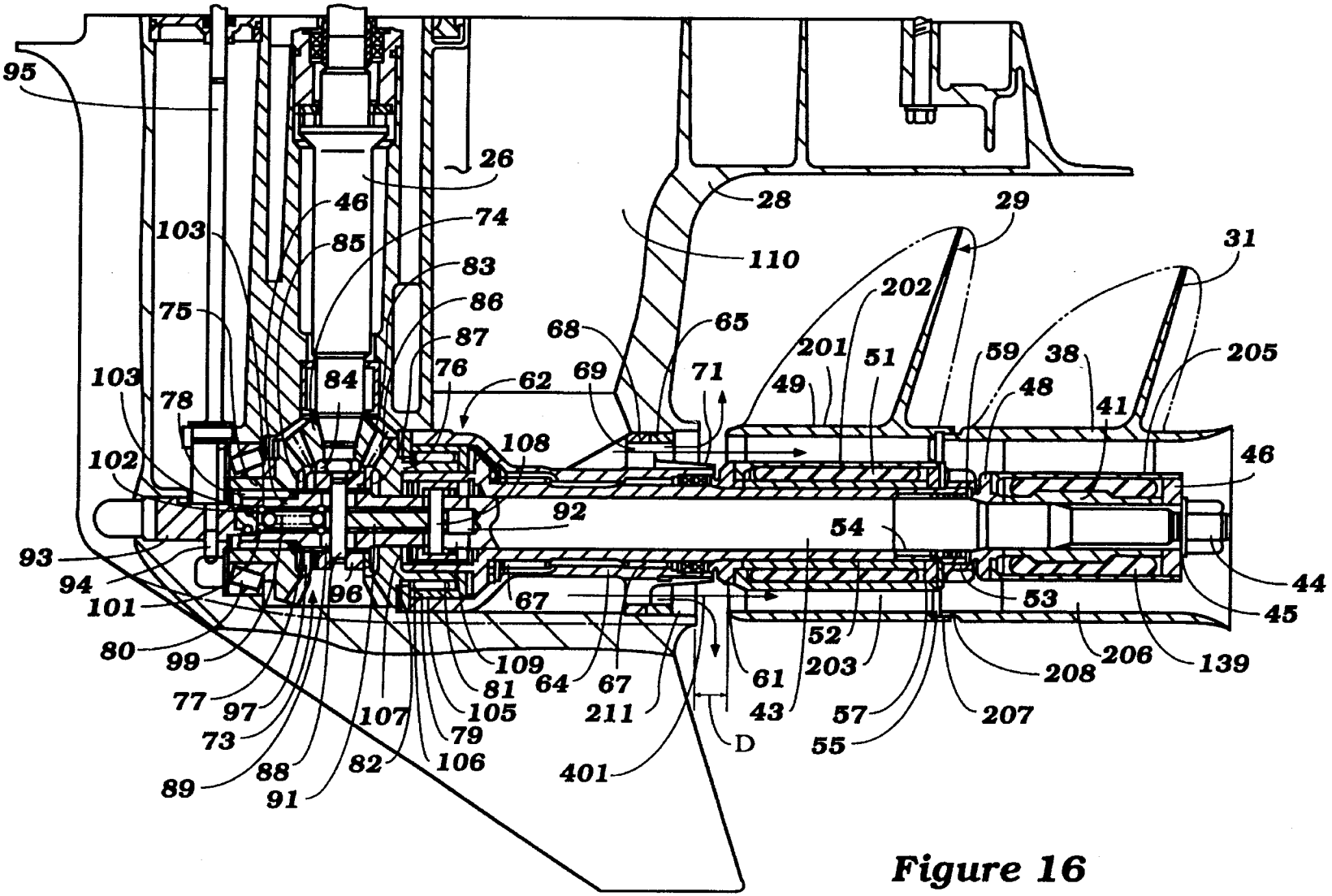
FIG. 16 is a cross-sectional view, in part similar to FIGS. 2, 4, 7, 10, and 14, and shows a sixth embodiment of the invention.

FIG. 16 shows a final embodiment that achieves the same effect in a slightly different way. In this embodiment, the outer hub 201 of the hub 49 of the front propeller 29 is spaced rearwardly of the rear face of the lower unit housing 28 that defines the opening 63. This distance is indicated by the dimension D in FIG. 16 and forms a path through which the exhausts gases may pass when the flow of exhaust gases increases upon acceleration and when the water pressure is low due to low watercraft speed. Like the other embodiments, the amount of flow through the resulting gap, indicated by the reference numeral 401 will decrease as the speed of the watercraft increases in proportion to the total exhaust flow.

It should be readily apparent from the described embodiments of the invention, that the provision of a cavitation gas flow over the front propeller during acceleration improves the ability of the engine to accelerate without reducing the effectiveness at high speeds. In the described embodiments, the front propeller has been the propeller that is only driven in forward mode. It could be understood that this invention can be employed where there is a reversal of the propellers and the cavitation effect should be generated at the forward edge of the propeller which only drives in a forward mode. In addition, various other changes and modifications may be made, such as using a different source of gas flow for achieving the cavitation, without departing from the spirit and scope of the invention, as defined by the appended claims.

We claim:

1. A propulsion system for a watercraft having a pair of propellers of opposite hand, rotatable about a common axis and juxtaposed to each other, one propeller being disposed to the front of the other, transmission means for driving said propellers in opposite directions, a means for delivering a controlled amount of gas in the vicinity of only one of said propellers at least upon acceleration for producing a cavitation effect only on that one propeller to allow the drive for said propellers to accelerate more rapidly.

2. The propulsion system for a watercraft as set forth in claim 1, wherein the gas is delivered at a location outwardly of the outer periphery of the hub of the one propeller.

3. The propulsion system for a watercraft as set forth in claim 2, wherein the gas is delivered around substantially the total circumference of the outer hub of the one propeller.

4. The propulsion system for a watercraft as set forth in claim 2, wherein the gas is delivered at a location on the sides of the outer periphery of the hub of the one propeller.

5. The propulsion system for a watercraft as set forth in claim 2, wherein the gas is delivered at a location on the area above the top of the hub of the one propeller.

6. The propulsion system for a watercraft as set forth in claim 5, wherein the gas is also delivered at a location below the lower portion of the hub of the one propeller.

7. The propulsion system for a watercraft as set forth in claim 1, wherein the one propeller is the front propeller.

8. The propulsion system for a watercraft as set forth in claim 7, wherein the hub of the rear propeller is no larger than that of the front propeller.

9. The propulsion system for a watercraft as set forth in claim 1, wherein the transmission means is effective to reverse the direction of driving rotation of at least one of the propellers.

10. The propulsion system for a watercraft as set forth in claim 9, wherein the propeller that is reversed is not the one propeller.

11. The propulsion system for a watercraft as set forth in claim 1, wherein the gas comprises the exhaust gases from an engine driving the transmission means.

12. The propulsion system for a watercraft as set forth in claim 11, wherein not all of the exhaust gases flowing from the engine are delivered in the vicinity of the one propeller.

13. The propulsion system for a watercraft as set forth in claim 12, wherein some of the exhaust gases flow through the hub of the one propeller.

14. The propulsion system for a watercraft as set forth in claim 13, wherein some of the exhaust gases flow through the hubs of both of the propellers.

15. The propulsion system for a watercraft as set forth in claim 11, wherein the transmission means is effective to reverse the direction of driving rotation of at least one of the propellers.

16. The propulsion system for a watercraft as set forth in claim 15, wherein the propeller that is reversed is not the one propeller.

17. The propulsion system for a watercraft as set forth in claim 16, wherein the one propeller comprises the front propeller.

18. The propulsion system for a watercraft as set forth in claim 11, wherein the one propeller comprises the front propeller.

19. The propulsion system for a watercraft as set forth in claim 18, wherein the gas is delivered at a location outwardly of the outer periphery of the hub of the one propeller.

20. The propulsion system for a watercraft as set forth in claim 19, wherein the gas is delivered around substantially the total circumference of the outer hub of the one propeller.

21. The propulsion system for a watercraft as set forth in claim 19, wherein the gas is delivered at a location on the sides of the outer periphery of the hub of the one propeller.

22. The propulsion system for a watercraft as set forth in claim 19, wherein the gas is delivered at a location on the area above the top of the hub of the one propeller.

23. The propulsion system for a watercraft as set forth in claim 22, wherein the gas is also delivered at a location below the lower portion of the hub of the one propeller.

24. The propulsion system for a watercraft as set forth in claim 18, wherein not all of the exhaust gases flowing from the engine are delivered in the vicinity of the one propeller.

25. The propulsion system for a watercraft as set forth in claim 24, wherein some of the exhaust gases flow through the hub of the one propeller.

26. The propulsion system for a watercraft as set forth in claim 25, wherein some of the exhaust gases flow through the hubs of both of the propellers.

* * * * *